US009194382B2

(12) United States Patent
Shin et al.

(10) Patent No.: US 9,194,382 B2
(45) Date of Patent: Nov. 24, 2015

(54) HYDRAULIC PUMP CONTROL SYSTEM FOR CONSTRUCTION MACHINERY

(75) Inventors: Hung-Ju Shin, Changwon-si (KR); Hea-Gyoon Joung, Busan (KR); Sang-Hee Lee, Changwon-si (KR)

(73) Assignee: VOLVO CONTRUCTION EQUIPMENT AB (SE)

( * ) Notice: Subject to any disclaimer, the term of this patent is extended or adjusted under 35 U.S.C. 154(b) by 380 days.

(21) Appl. No.: 13/700,969

(22) PCT Filed: Jun. 24, 2010

(86) PCT No.: PCT/KR2010/004097

§ 371 (c)(1),
(2), (4) Date: Nov. 29, 2012

(87) PCT Pub. No.: WO2011/162429

PCT Pub. Date: Dec. 29, 2011

(65) Prior Publication Data

US 2013/0098021 A1 Apr. 25, 2013

(51) Int. Cl.
*F04B 9/10* (2006.01)
*E02F 9/22* (2006.01)
(Continued)

(52) U.S. Cl.
CPC . *F04B 9/10* (2013.01); *E02F 9/123* (2013.01); *E02F 9/2235* (2013.01); *E02F 9/2253* (2013.01); *E02F 9/2285* (2013.01); *E02F 9/2296* (2013.01); *F04B 27/14* (2013.01); *F15B 11/0423* (2013.01); *F15B 2211/20546* (2013.01); *F15B 2211/255* (2013.01); *F15B 2211/26* (2013.01); *F15B 2211/6309* (2013.01); *F15B 2211/6346* (2013.01); *F15B 2211/6652* (2013.01); *F15B 2211/6654* (2013.01);
(Continued)

(58) Field of Classification Search
CPC .... F15B 11/0423; E02F 9/123; E02F 9/2235; E02F 9/2296
USPC ..... 60/452
See application file for complete search history.

(56) References Cited

U.S. PATENT DOCUMENTS 5,245,828 A 9/1993 Nakamura
6,651,544 B2 11/2003 Skinner
(Continued)

FOREIGN PATENT DOCUMENTS

CN 1573126 A 2/2005
EP 1479920 A2 11/2004
(Continued)

OTHER PUBLICATIONS

International Search Report (in Korean with English translation) and Written Opinion of the International Searching Authority (in Korean) for PCT/KR2010/004097, mailed Mar. 28, 2011; ISA/KR.
(Continued)

*Primary Examiner* — Thomas E Lazo
(74) *Attorney, Agent, or Firm* — Harness, Dickey & Pierce, P.L.C.

(57) ABSTRACT

A hydraulic pump control system provided in a construction machine such as an excavator is provided. According to the hydraulic pump control system, a loss of a flow rate is reduced by initially supplying hydraulic fluid as much as necessary from a hydraulic pump to a hydraulic motor in order to accelerate a swing movement of an upper frame against a lower traveling structure or to make an upper swing structure swing.

5 Claims, 3 Drawing Sheets

(51) Int. Cl.

| | |
|---|---|
| ***F04B 27/14*** | (2006.01) |
| ***E02F 9/12*** | (2006.01) |
| ***F15B 11/042*** | (2006.01) |

(52) U.S. Cl.
CPC . *F15B2211/6655* (2013.01); *F15B 2211/7058* (2013.01); *F15B 2211/851* (2013.01)

(56) References Cited

U.S. PATENT DOCUMENTS

| | | | | |
|---|---|---|---|---|
| 6,981,371 | B2 * | 1/2006 | Imanishi et al. | 60/420 |
| 7,392,653 | B2 * | 7/2008 | Sugano | 60/452 |
| 2003/0121257 | A1 | 7/2003 | Skinner | |
| 2003/0121409 | A1 | 7/2003 | Lunzman et al. | |
| 2009/0217656 | A1 | 9/2009 | Yoshimoto et al. | |

FOREIGN PATENT DOCUMENTS

| | | | |
|---|---|---|---|
| JP | 03-110225 | A | 5/1991 |
| JP | 07-063202 | A | 3/1995 |
| JP | 09-165793 | A | 6/1997 |
| JP | 10-226498 | A | 8/1998 |
| JP | 11-108003 | A | 4/1999 |
| JP | 2001-182719 | A | 7/2001 |
| JP | 2003-206902 | A | 7/2003 |
| JP | 2003-239906 | A | 8/2003 |
| JP | 2006-177560 | A | 7/2006 |
| KR | 10-1995-0004531 | B1 | 5/1995 |
| KR | 10-2008-0091847 | A | 10/2008 |

OTHER PUBLICATIONS

International Preliminary Report on Patentability (in Korean) for PCT/KR2010/004097, dated Oct. 9, 2012; IPEA/KR.
Extended European Search Report for Application No. EP 10 85 3712 dated Feb. 28, 2014 (7 pages).
Japanese Office Action for Application No. 2013-516482 dated Mar. 11, 2014 (no English translation available).
First Office Action issued by China State Intellectual Property Office for 201080066909 (in Chinese with English Translation) dated Aug. 25, 2014 (10 pages).

* cited by examiner

HYDRAULIC PUMP CONTROL SYSTEM FOR CONSTRUCTION MACHINERY

TECHNICAL FIELD

The present invention relates to a hydraulic pump control system provided in a construction machine such as an excavator. More particularly, the present invention relates to a hydraulic pump control system for a construction machine, which can supply hydraulic fluid as much as necessary from a variable displacement hydraulic pump (hereinafter referred to as a "hydraulic pump") to a hydraulic motor at an initial stage to accelerate a swing movement of an upper swing structure when an upper frame against a lower traveling structure is rotated or a traveling motor is accelerated for traveling.

BACKGROUND ART

In general, a hydraulic construction machine controls the flow rate of a variable displacement hydraulic pump in accordance with the operation rate of an operation lever (which means pilot signal pressure that is supplied to a spool in proportion to the operation rate of the operation lever to shift the spool that controls the flow of hydraulic fluid) in order to save energy. Further, a fixed displacement hydraulic motor is mostly used, and the flow rate that can flow into the hydraulic motor is limited to a value that is obtained by multiplying the number of revolutions by a volume of the hydraulic motor.

In such a hydraulic system, if an operator abruptly operates the operation lever to make an upper swing structure swing as shown in a graph illustrated in FIG. 1, the number of revolutions of the hydraulic motor is not sufficient and is unable to cope with the initially generated discharge flow rate of the hydraulic pump (the flow rate that actually flows into the hydraulic motor is indicated by a dotted line in the drawing).

At this time, as the pressure that flow into the hydraulic motor in the swing acceleration period is increased, a great amount of hydraulic fluid passes through a port relief valve or a main relief valve. In this case, since the generated energy is not converted into work in all, but the flow rate partially returns to the hydraulic tank through the relief valve, a loss of the flow rate (a loss of the flow rate as much as the shaded portion) occurs.

DISCLOSURE

Technical Problem

Therefore, the present invention has been made to solve the above-mentioned problems occurring in the related art, and one embodiment of the present invention is related to a hydraulic pump control system for a construction machine, which can increase the efficiency by reducing a flow rate that is supplied to a hydraulic motor at an initial stage when a swing movement of an upper swing structure is accelerated by the hydraulic motor.

One embodiment of the present invention is related to a hydraulic pump control system for a construction machine, which can reduce impact by reducing a flow supply rate even when an operator abruptly operates an operation lever to make an upper swing structure swing.

One embodiment of the present invention is related to a hydraulic pump control system for a construction machine, which does not limit a flow increasing rate in a state where the flow increasing rate is not higher than a predetermined set value, and thus makes an operator be unable to feel falling of initial acceleration.

Technical Solution

In accordance with one aspect of the present invention, there is provided a hydraulic pump control system for a construction machine including a variable displacement hydraulic pump, a hydraulic actuator connected to the hydraulic pump, a control valve controlling hydraulic fluid supplied to the hydraulic actuator when shifted by signal pressure that is in proportion to an operation rate of an operation lever, a detection sensor detecting the operation rate of the operation lever, and a control unit controlling a discharge flow rate of the hydraulic pump in accordance with a detection signal from the detection sensor, the hydraulic pump control system including: a first step of detecting the operation rate of the operation lever by the detection sensor; a second step of calculating a flow rate that is required in the hydraulic pump in accordance with the operation rate of the operation lever; a third step of comparing and determining levels of the calculated flow rate and a preset dead-zone value; a fourth step of calculating a flow increasing rate as the calculated required flow rate if the calculated flow rate exceeds the dead-zone value; a fifth step of comparing and determining levels of the calculated flow increasing rate and a preset flow increasing rate limit value; a sixth step of setting the discharge flow rate of the hydraulic pump to the flow increasing rate limit value that is lower than the flow rate required in the hydraulic pump in accordance with the operation rate if the calculated flow increasing rate exceeds the flow increasing rate limit value; and a seventh step of setting the discharge flow rate of the hydraulic pump to the required flow rate in accordance with the operation rate if the calculated flow rate is lower than the dead-zone value in the third step, wherein in the case of accelerating a swing movement of an upper swing structure that is driven by the hydraulic actuator, the flow rate supplied to the hydraulic actuator is reduced by limiting the discharge flow increasing rate of the hydraulic pump with lapse of time.

In accordance with another aspect of the present invention, there is provided a hydraulic pump control system for a construction machine including a variable displacement hydraulic pump, a hydraulic actuator connected to the hydraulic pump, a control valve controlling hydraulic fluid supplied to the hydraulic actuator when shifted by signal pressure that is in proportion to an operation rate of an operation lever, a detection sensor detecting the operation rate of the operation lever, a detection sensor detecting discharge pressure of the hydraulic pump, and a control unit controlling a discharge flow rate of the hydraulic pump in accordance with a detection signal from the detection sensor, the hydraulic pump control system including: a first step of detecting the operation rate of the operation lever and the discharge pressure of the hydraulic pump by the detection sensors; a second step of calculating a flow rate that is required in the hydraulic pump in accordance with the operation rate of the operation lever; a third step of comparing and determining levels of an actual pressure value detected by the detection sensor and a preset pressure limit value; a fourth step of setting a value that is obtained by subtracting a value, which is obtained by multiplying a difference value between the detected pressure value and the pressure limit value by a constant, from the required flow rate in accordance with the operation rate, as the discharge flow rate of the hydraulic pump if the pressure value detected in the third step is larger than the pressure limit value; and a fifth step of setting the discharge flow rate of the hydraulic pump to the required flow rate in accordance with the operation rate if the pressure value detected in the third step is smaller than the pressure limit value, wherein in the case of accelerating a swing movement of an upper swing structure that is driven by the hydraulic motor, the flow rate supplied to the hydraulic actuator is reduced by feeding the detected pressure of the hydraulic pump back to the discharge flow rate of the hydraulic pump.

In accordance with the aspect of the present invention, the hydraulic pump control system may further include a detection sensor installed in a discharge flow path of the variable displacement hydraulic pump to detect discharge pressure of the hydraulic pump, wherein a torque is calculated using the detected pressure and a volume of the hydraulic pump, and the volume of the hydraulic pump is reduced so that the increasing rate of the calculated torque value is limited with the lapse of time.

In the case of controlling the discharge flow rate of the variable displacement hydraulic pump, a specified pressure value may be set, and if an actual pressure value detected by the detection sensor is larger than the specified pressure value, the volume of the hydraulic pump may be reduced by multiplying a difference value between the actually detected pressure value and the specified pressure value by a specified constant and feeding the result of multiplication back to a hydraulic flow control signal.

In the case of controlling the discharge flow rate of the variable displacement hydraulic pump, a specified torque value may be set, and if a calculated torque value is larger than the specified torque value, the volume of the hydraulic pump may be reduced by multiplying a difference value between the calculated torque value and the specified torque value by a specified constant and feeding the result of multiplication back to a hydraulic flow control signal.

A horsepower may be calculated using the actual pressure value detected by the detection sensor and the discharge flow rate of the hydraulic pump, and the discharge flow rate of the hydraulic pump may be reduced so that the increasing amount of the calculated horsepower value is limited with the lapse of time.

In the case of controlling the discharge flow rate of the variable displacement hydraulic pump, a specified horsepower value may be set, and if a calculated horsepower value may be larger than the specified horsepower value, the discharge flow rate of the hydraulic pump may be reduced by multiplying a difference value between the calculated horsepower value and the specified horsepower value by a specified constant and feeding the result of multiplication back to a hydraulic flow control signal.

Advantageous Effect

The hydraulic pump control system for a construction machine as configured above according to the aspect of the present invention has the following advantages.

When the swing movement of the upper swing structure is accelerated by the hydraulic motor, the efficiency is increased by reducing the loss of the hydraulic fluid that is supplied from the hydraulic pump to the hydraulic motor at the initial stage, and thus the fuel consumption ratio can be improved.

Even when the operator abruptly operates the operation lever to make the upper swing structure swing, the impact is reduced through the decrease of the flow supply rate and thus the feeling of operation can be heightened.

Further, the dead-zone area in which a flow increasing rate is not limited is set in a state where the flow increasing rate is not higher than the predetermined set value, and thus the initial acceleration force can be operated according to the operator's intention.

BRIEF DESCRIPTION OF THE DRAWINGS

The above objects, other features and advantages of the present invention will become more apparent by describing the preferred embodiments thereof with reference to the accompanying drawings, in which.

DESCRIPTION OF REFERENCE NUMERALS IN THE DRAWING

Figure 1:
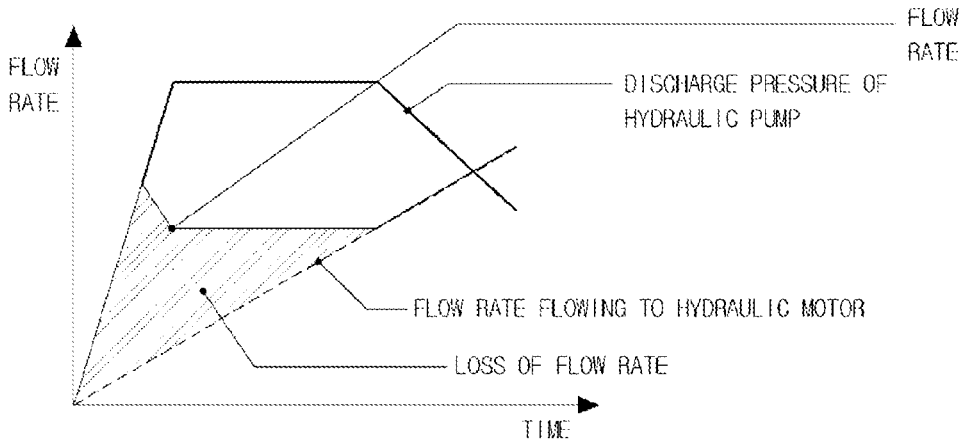
FIG. 1 is a graph showing loss of a part of the flow rate initially supplied from a hydraulic pump to a hydraulic motor when a swing movement of an upper swing structure of a construction equipment is accelerated by a hydraulic motor.

1: engine
2: variable displacement hydraulic pump
3: pilot pump
4: hydraulic actuator
5: operation lever
6: control valve
7, 8: detection sensor
9: control unit

BEST MODE

Now, preferred embodiments of the present invention will be described in detail with reference to the accompanying drawings. The matters defined in the description, such as the detailed construction and elements, are nothing but specific details provided to assist those of ordinary skill in the art in a comprehensive understanding of the invention, and the present invention is not limited to the embodiments disclosed hereinafter.

Figure 2:
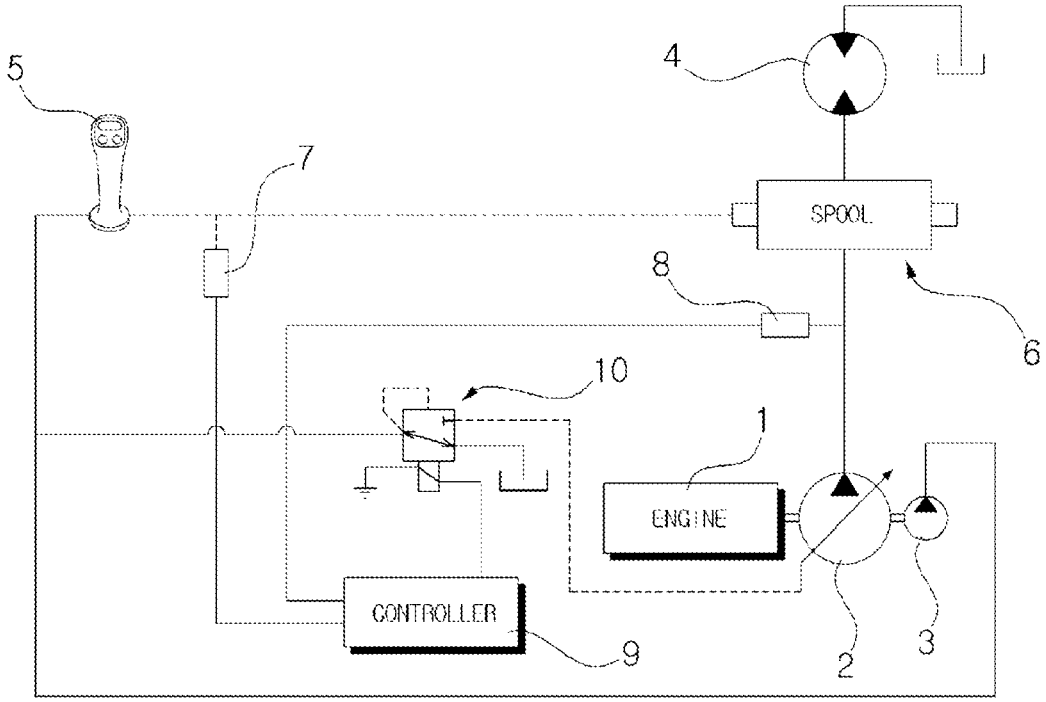
FIG. 2 is a schematic diagram of a hydraulic circuit that is applied to a hydraulic pump control system for a construction machine according to an embodiment of the present invention.
Figure 3:
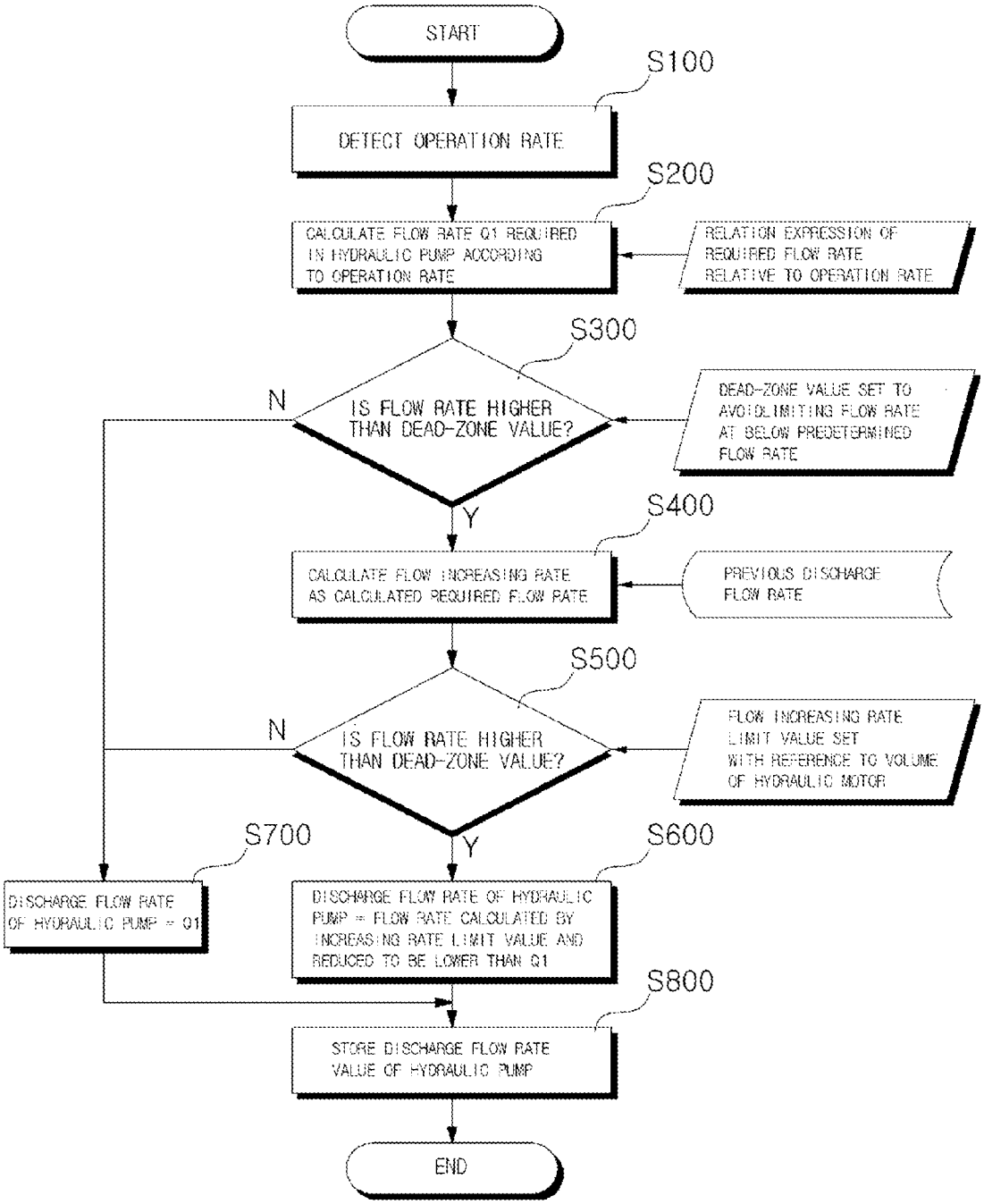
FIG. 3 is a flowchart illustrating the operation of a hydraulic pump control system for a construction machine according to an embodiment of the present invention.
Figure 4:
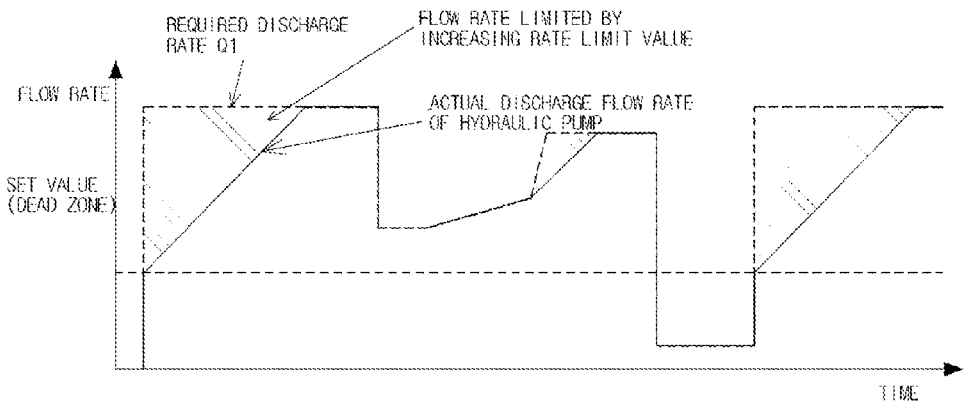
FIG. 4 is a graph showing the relationship between a required discharge rate of a hydraulic pump and an actual discharge flow rate when a flow increasing rate of the hydraulic pump is limited in a hydraulic pump control system for a construction machine according to an embodiment of the present invention.

According to an embodiment of the present invention as illustrated in FIGS. 2 to 4, a hydraulic pump control system for a construction machine, which has a variable displacement hydraulic pump (hereinafter referred to as a "hydraulic pump") 2 connected to an engine 1 and a pilot pump 3, a hydraulic actuator 4 (for example, a hydraulic motor) connected to the hydraulic pump 2, a control valve 6 (in the drawing, a spool is illustrated) controlling hydraulic fluid supplied to the hydraulic actuator 4 when shifted by pilot signal pressure that is in proportion to an operation rate of an operation lever 5, a detection sensor 7 detecting the operation rate of the operation lever 5, and a control unit 9 controlling a discharge flow rate of the hydraulic pump 2 in accordance with a detection signal from the detection sensor 7, includes: a first step S100 of detecting the operation rate of the operation lever 5 by the detection sensor 7; a second step S200 of calculating a flow rate Q1 that is required in the hydraulic pump 2 in accordance with the operation rate of the operation lever 5; a third step S300 of comparing and determining levels of the calculated flow rate and a preset dead-zone value; a fourth step S400 of calculating a flow increasing rate as the calculated required flow rate if the calculated flow rate exceeds the dead-zone value; a fifth step S500 of comparing and determining levels of the calculated flow increasing rate and a preset flow increasing rate limit value; a sixth step S600 of setting the discharge flow rate of the hydraulic pump 2 to the flow increasing rate limit value that is lower than the flow rate required in the hydraulic pump 2 in accordance with the operation rate if the calculated flow increasing rate exceeds the flow increasing rate limit value; and a seventh step S700 of setting the discharge flow rate of the hydraulic pump 2 to the required flow rate Q1 in accordance with the operation rate if the calculated flow rate is lower than the dead-zone value in the third step S300, wherein in the case of accelerating a swing movement of an upper swing structure (not illustrated) that is driven by the hydraulic actuator 4, the flow rate supplied to the hydraulic actuator 4 is reduced by limiting the discharge flow increasing rate of the hydraulic pump 2 with lapse of time.

The hydraulic pump control system according to an embodiment of the present invention may further include a detection sensor 8 installed in a discharge flow path of the hydraulic pump 2 to detect discharge pressure of the hydraulic pump 2, wherein a torque is calculated using the detected pressure and a volume of the hydraulic pump 2, and the volume of the hydraulic pump 2 is reduced so that the increasing rate of the calculated torque value is limited with the lapse of time.

In the case of controlling the discharge flow rate of the hydraulic pump 2, a specified pressure value may be set, and if an actual pressure value detected by the detection sensor 8 is larger than the specified pressure value, the volume of the hydraulic pump 2 may be reduced by multiplying a difference value between the actually detected pressure value and the specified pressure value by a specified constant and feeding the result of multiplication back to a hydraulic flow control signal.

In the case of controlling the discharge flow rate of the hydraulic pump 2, a specified torque value may be set, and if a calculated torque value is larger than the specified torque value, the volume of the hydraulic pump 2 may be reduced by multiplying a difference value between the calculated torque value and the specified torque value by a specified constant and feeding the result of multiplication back to a hydraulic flow control signal.

A horsepower may be calculated using the actual pressure value detected by the detection sensor 8 and the discharge flow rate of the hydraulic pump 2, and the discharge flow rate of the hydraulic pump 2 may be reduced so that the increasing amount of the calculated horsepower value is limited with the lapse of time.

In the case of controlling the discharge flow rate of the hydraulic pump 2, a specified horsepower value may be set, and if a calculated horsepower value may be larger than the specified horsepower value, the discharge flow rate of the hydraulic pump 2 may be reduced by multiplying a difference value between the calculated horsepower value and the specified horsepower value by a specified constant and feeding the result of multiplication back to a hydraulic flow control signal.

In the drawings, the reference numeral 10 denotes a proportional control valve that changes the signal pressure supplied from the operation lever 5 in proportion to a control signal from the control unit 9 in order to control the discharge flow rate of the hydraulic pump 2.

Hereinafter, the use example of the hydraulic pump control system for a construction machine according to an embodiment of the present invention will be described in detail with reference to the accompanying drawings.

As shown in FIG. 3, the operation rate of the operation lever 5 is detected by the detection sensor 7 (see S100).

As in S200, the discharge flow rate Q1 that is required in the hydraulic pump 2 is calculated in accordance with the operation rate of the operation lever 5. That is, the required discharge flow rate Q1 relative to the operation rate of the operation lever 5 is calculated by a relation expression or a table (not illustrated).

As in S300, the levels of the calculated flow rate Q1 and the preset dead-zone value are compared with each other and determined. If the flow rate exceeds the dead-zone value, the processing proceeds to the next step S400, and if the flow rate does not exceed the dead-zone value, the processing proceeds to S700. At this time, the dead-zone value is set not to limit the flow increasing rate if the discharge flow rate of the hydraulic pump 2 does not exceed the set value.

As in S400, if the calculated flow rate exceeds the dead-zone value, the flow increasing rate is calculated as the calculated required flow rate Q1.

As in S500, the levels of the calculated flow increasing rate (limit value set in consideration of the volume of the hydraulic actuator 4) and the preset flow increasing rate limit value are compared with each other and determined. If the flow increasing rate exceeds the flow increasing rate, the processing proceeds to the next step S600, and if the flow increasing rate does not exceed the flow increasing rate, the processing proceeds to S700.

As in S600, if the calculated flow increasing rate exceeds the flow increasing rate limit value, the discharge flow rate of the hydraulic pump 2 is set as the flow increasing rate limit value that is lower than the flow rate Q1 that is required in the hydraulic pump 2 according to the operation rate.

As in S700, if the calculated flow rate is lower than the dead-zone value in the third step S300, or if the flow increasing rate is lower than the flow increasing rate limit value in the fifth step S500, the discharge flow rate of the hydraulic pump 2 is set as the required flow rate Q1 according to the operation rate.

As in S800, the discharge flow rate value of the hydraulic pump 2 set in the sixth step S600 or the seventh step S700 is stored.

As shown in FIG. 4, according to the hydraulic pump control system for a construction machine according to an embodiment of the present invention, if the swing of the upper swing structure is accelerated by the driving of the hydraulic actuator 4, the operation rate of the operation lever 5 by an operator is detected by the detection sensor 7, and the flow rate Q1 that is required by the hydraulic pump 2 is calculated.

At this time, if the calculated discharge flow rate Q1 is not higher than the specified value (that is, dead-zone value), the required flow rate Q1 (indicated by a dotted line) according to the operation rate is discharged from the hydraulic pump 2. By contrast, if the calculated discharge flow rate Q1 exceeds the specified value, the flow increasing rate is limited, and thus the actual discharge flow rate (indicated by a solid line) of the hydraulic pump 2 can be reduced.

Through this, even if the discharge flow increasing rate of the hydraulic pump 2 is limited, the flow rate supplied to the hydraulic actuator 4 as much as the shaded portion in FIG. 4 can be reduced.

According to another embodiment of the present invention as illustrated in FIGS. 2 to 5, a hydraulic pump control system for a construction machine, which has a variable displacement hydraulic pump 2 connected to an engine 1 and a pilot pump 3, a hydraulic actuator 4 (for example, hydraulic motor) connected to the hydraulic pump 1, a control valve 6 (in the drawing, a spool is illustrated) controlling hydraulic fluid supplied to the hydraulic actuator 4 when shifted by signal pressure that is in proportion to an operation rate of an operation lever 5, a detection sensor 7 detecting the operation rate of the operation lever 5, a detection sensor 8 detecting discharge pressure of the hydraulic pump 2, and a control unit 9 controlling a discharge flow rate of the hydraulic pump 2 in accordance with a detection signal from the detection sensor 7, includes: a first step S1000 of detecting the operation rate of the operation lever 5 and the discharge pressure of the hydraulic pump 2 by the detection sensors 7 and 8; a second step S2000 of calculating a flow rate Q1 that is required in the hydraulic pump 2 in accordance with the operation rate of the operation lever 5; a third step S3000 of comparing and determining levels of an actual pressure value detected by the detection sensor 8 and a preset pressure limit value; a fourth step S4000 of setting a value that is obtained by subtracting a value, which is obtained by multiplying a difference value between the detected pressure value and the pressure limit value by a constant (gain), from the required flow rate Q1 in accordance with the operation rate, as the discharge flow rate of the hydraulic pump 2 if the pressure value detected in the third step S3000 is larger than the pressure limit value; and a fifth step S5000 of setting the discharge flow rate of the hydraulic pump 2 to the required flow rate Q1 in accordance with the operation rate if the pressure value detected in the third step S3000 is smaller than the pressure limit value, wherein in the case of accelerating swing of an upper swing structure that is driven by the hydraulic motor 4, the flow rate supplied to the hydraulic actuator 4 is reduced by feeding the detected pressure of the hydraulic pump 2 back to the discharge flow rate of the hydraulic pump 2.

Hereinafter, the use example of the hydraulic pump control system for a construction machine according to another embodiment of the present invention will be described in detail with reference to the accompanying drawings.

Figure 5:
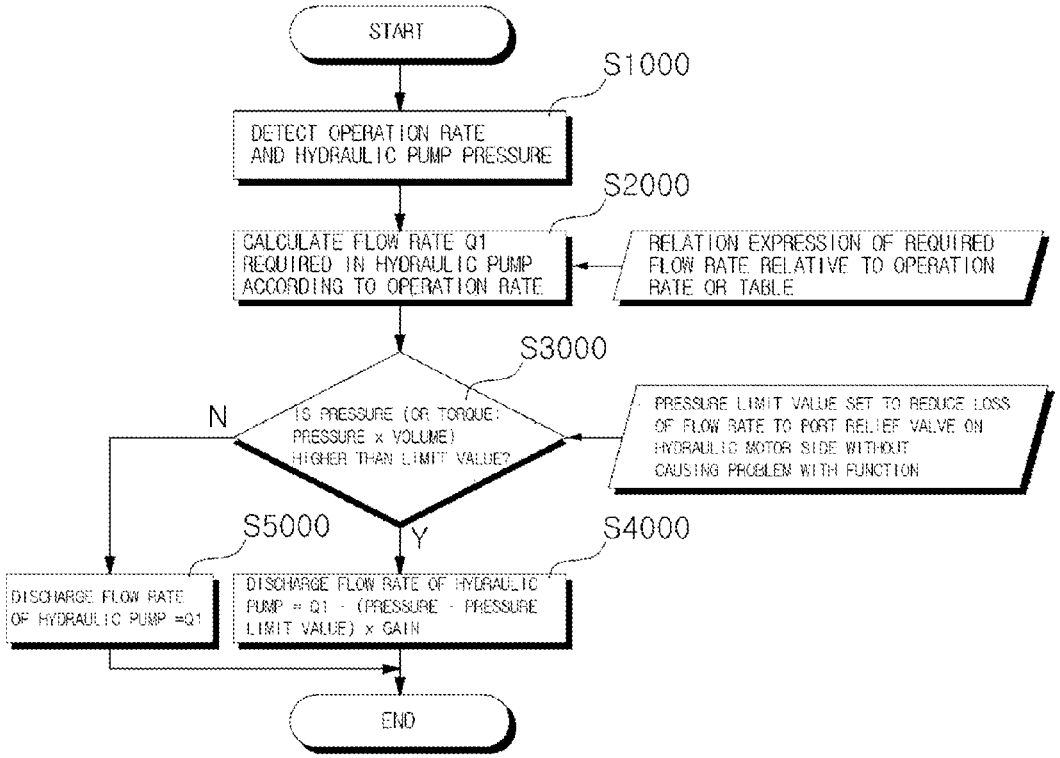
FIG. 5 is a flowchart illustrating the operation of a hydraulic pump control system for a construction machine according to another embodiment of the present invention.

As shown in FIG. 5, the operation rate of the operation lever 5 is detected by the detection sensor 7, and the discharge pressure of the hydraulic pump 2 is detected by the detection sensor 8 (see S1000).

As in S2000, the discharge flow rate Q1 that is required in the hydraulic pump 2 is calculated in accordance with the operation rate of the operation lever 5. That is, the required discharge flow rate Q1 relative to the operation rate of the operation lever 5 is calculated by a relation expression or a table (not illustrated).

As in S3000, the levels of the actual pressure value that is detected by the detection sensor 8 and the preset pressure limit value are compared with each other. If the actual pressure value exceeds the pressure limit value, the processing proceeds to the next step S4000, and if the actual pressure value is smaller than the preset pressure limit value, the processing proceeds to S5000. At this time, as the actual pressure value, a torque value that is obtained by multiplying a pressure by a volume may be used. The pressure limit value means a pressure value that is set to reduce a loss of the flow rate to a port relief value on the side of the hydraulic actuator 4 without interfering with the function of the equipment.

As in S4000, if the pressure value that is detected by the detection sensor 8 in the first step S1000 is larger than the pressure limit value, a value that is obtained by subtracting a value, which is obtained by multiplying a difference value between the detected pressure value and the pressure limit value by a constant (gain), from the required flow rate Q1 in accordance with the operation rate, is set as the discharge flow rate of the hydraulic pump ((the required flow rate Q1—(the detected pressure value—the pressure limit value)×the gain)).

As described above, according to the hydraulic pump control system for a construction machine according to another embodiment of the present invention, in the case of accelerating the swing movement of the upper swing structure that is driven by the hydraulic actuator 4, the flow rate that is supplied to the hydraulic actuator 4 can be reduced by feeding the discharge pressure of the hydraulic pump 2 detected by the detection sensor back to the discharge flow rate of the hydraulic pump 2.

INDUSTRIAL APPLICABILITY

As apparent from the above description, according to the hydraulic pump control system for a construction machine according to the embodiments of the present invention, in the case of accelerating the swing movement of the upper swing structure by the hydraulic motor, the fuel consumption ratio is improved by preventing the loss of the flow rate through limiting of the discharge flow increasing rate of the hydraulic pump with the lapse of time.

Further, even when the operator abruptly operates the operation lever to make the upper swing structure swing, the feeling of operation can be heightened by reducing the flow supply rate. If the flow increasing rate is not higher than the predetermined value, the dead-zone area in which the flow increasing rate is not limited is set, and thus the initial acceleration force can be operated according to the operator's intention.

The invention claimed is:

1. A hydraulic pump control system for a construction machine including a variable displacement hydraulic pump, a hydraulic actuator connected to the hydraulic pump, a control valve controlling hydraulic fluid supplied to the hydraulic actuator when shifted by signal pressure that is in proportion to an operation rate of an operation lever, a detection sensor detecting the operation rate of the operation lever, and a control unit controlling a discharge flow rate of the hydraulic pump in accordance with a detection signal from the detection sensor, the hydraulic pump control system comprising:

a first step of detecting the operation rate of the operation lever by the detection sensor;

a second step of calculating a flow rate that is required in the hydraulic pump in accordance with the operation rate of the operation lever;

a third step of comparing and determining levels of the calculated flow rate and a preset dead-zone value;

a fourth step of calculating a flow increasing rate as the calculated required flow rate if the calculated flow rate exceeds the dead-zone value;

a fifth step of comparing and determining levels of the calculated flow increasing rate and a preset flow increasing rate limit value;

a sixth step of setting the discharge flow rate of the hydraulic pump to the flow increasing rate limit value that is lower than the flow rate required in the hydraulic pump in accordance with the operation rate if the calculated flow increasing rate exceeds the flow increasing rate limit value;

a seventh step of setting the discharge flow rate of the hydraulic pump to the required flow rate in accordance with the operation rate if the calculated flow rate is lower than the dead-zone value in the third step; and a detection sensor installed in a discharge flow path of the variable displacement hydraulic pump to detect discharge pressure of the hydraulic pump;

wherein in the case of accelerating a swing movement of an upper swing structure that is driven by the hydraulic actuator, the flow rate supplied to the hydraulic actuator is reduced by limiting the discharge flow increasing rate of the hydraulic pump with lapse of time; and wherein a torque is calculated using the detected pressure and a volume of the hydraulic pump, and the volume of the hydraulic pump is reduced so that the increasing rate of the calculated torque value is limited with the lapse of time.

2. The hydraulic pump control system for a construction machine according to claim 1, wherein in the case of controlling the discharge flow rate of the variable displacement hydraulic pump, a specified pressure value is set, and if an actual pressure value detected by the detection sensor is larger than the specified pressure value, the volume of the hydraulic pump is reduced by multiplying a difference value between the actually detected pressure value and the specified pressure value by a specified constant and feeding the result of multiplication back to a hydraulic flow control signal.

3. The hydraulic pump control system for a construction machine according to claim 1, wherein in the case of controlling the discharge flow rate of the variable displacement hydraulic pump, a specified torque value is set, and if a calculated torque value is larger than the specified torque value, the volume of the hydraulic pump is reduced by multiplying a difference value between the calculated torque value and the specified torque value by a specified constant and feeding the result of multiplication back to a hydraulic flow control signal.

4. The hydraulic pump control system for a construction machine according to claim 1, wherein a horsepower is calculated using the actual pressure value detected by the detection sensor and the discharge flow rate of the hydraulic pump, and the discharge flow rate of the hydraulic pump is reduced so that the increasing amount of the calculated horsepower value is limited with the lapse of time.

5. The hydraulic pump control system for a construction machine according to claim 4, wherein in the case of controlling the discharge flow rate of the variable displacement hydraulic pump, a specified horsepower value is set, and if a calculated horsepower value is larger than the specified horsepower value, the discharge flow rate of the hydraulic pump is reduced by multiplying a difference value between the calculated horsepower value and the specified horsepower value by a specified constant and feeding the result of multiplication back to a hydraulic flow control signal.

* * * * *